US008308899B2

(12) United States Patent
Kujanpaa et al.

(10) Patent No.: US 8,308,899 B2
(45) Date of Patent: Nov. 13, 2012

(54) SHATTER JET NOZZLE WITH MULTIPLE STEAM SOURCES AND METHOD FOR DISRUPTING SMELT FLOW TO A BOILER

(75) Inventors: Olli Kujanpaa, Marietta, GA (US); John Phillips, Alpharetta, GA (US)

(73) Assignee: Andritz Inc., Glens Falls, NY (US)

( * ) Notice: Subject to any disclaimer, the term of this patent is extended or adjusted under 35 U.S.C. 154(b) by 45 days.

(21) Appl. No.: 12/957,792

(22) Filed: Dec. 1, 2010

(65) Prior Publication Data

US 2011/0186659 A1 Aug. 4, 2011

Related U.S. Application Data

(60) Provisional application No. 61/266,252, filed on Dec. 3, 2009.

(51) Int. Cl.
*D21C 11/12* (2006.01)

(52) U.S. Cl. ..... 162/30.1

(58) Field of Classification Search ..... 162/30.1, 162/29, 30.11, 272, 239; 239/752; 266/196
See application file for complete search history.

(56) References Cited

U.S. PATENT DOCUMENTS

| | | | | |
|---|---|---|---|---|
| 3,122,421 | A * | 2/1964 | Gettle | 137/3 |
| 4,280,982 | A * | 7/1981 | Shindome et al. | 422/185 |
| 4,421,596 | A * | 12/1983 | Hogberg | 162/30.11 |
| 4,659,020 | A * | 4/1987 | Kutrow | 239/752 |
| 5,976,319 | A * | 11/1999 | Paju et al. | 162/30.1 |
| 7,501,042 | B2 * | 3/2009 | Manttari | 162/30.1 |
| 7,806,127 | B2 * | 10/2010 | Gibowski | 134/104.1 |
| 7,988,820 | B2 * | 8/2011 | Tanttu et al. | 162/31 |
| 2006/0157087 | A1 * | 7/2006 | Manttari | 134/34 |
| 2008/0079203 | A1 * | 4/2008 | Gibowski | 266/196 |

* cited by examiner

*Primary Examiner* — Mark Halpren
(74) *Attorney, Agent, or Firm* — Nixon & Vanderhye P.C.

(57) ABSTRACT

A method to disrupt a smelt flow including: arranging a shatter jet nozzle assembly to direct a jet of disrupting fluid against the smelt flowing from a recovery boiler to a dissolving tank; supplying the disrupting fluid to the shatter jet nozzle assembly from a first source of disrupting fluid to form the jet directed against the smelt flow while a second source does not provide disrupting fluid to the shatter jet nozzle, and supplying the disrupting fluid from both the first source and the second source flow to the shatter jet nozzle assembly to form the jet of disrupting fluid directed against the smelt flow.

17 Claims, 3 Drawing Sheets

SHATTER JET NOZZLE WITH MULTIPLE STEAM SOURCES AND METHOD FOR DISRUPTING SMELT FLOW TO A BOILER

CROSS RELATED APPLICATION

This application claims the benefit of application Ser. No. 61/266,252 filed Dec. 3, 2009, which is incorporated in its entirety by reference.

BACKGROUND OF THE INVENTION

The present invention relates to a shatter jet nozzle and a method for disrupting the smelt flow from a smelt spout of a recovery boiler.

A recovery boiler, such as a soda recovery boiler, is typically used in the chemical recovery of sulfate and other sodium-based substances from pulp manufacturing processes. Organic substances dissolved in the waste liquor during digestion or other pulping processes are combusted in the recovery boiler to melt inorganic compounds, e.g., ash, in the waste liquor and generate steam. The melted inorganic compounds flow as a primarily liquid smelt to the bottom of the recovery boiler. The smelt flows from the bottom of the boiler along one or more cooled smelt spouts to a dissolving tank. In the dissolving tank, the smelt is dissolved by water or weak white liquor to produce soda lye, e.g., green liquor.

The hot smelt flow from the spout causes "banging" and explosions when the smelt falls into the cooler liquid in the dissolving tank. The temperature of the smelt is on the order of 750° Celsius (° C.) to 820° C. In contrast, the temperature of the green liquor (or weak white liquor) in the dissolving tank, containing mainly water, is on the order of 70° C. to 100° C. This dramatic temperature difference between the hot smelt flow and the much cooler green liquor contributes to the explosions and banging noises as the smelt hits and is instantly cooled by the green liquor.

The intensity of the explosive reactions of the smelt in the dissolving tank may be reduced and controlled by disrupting the smelt flow into small streams, droplets or pieces as the flow leaves the spout and before it hits the liquid in the dissolving tank. It is conventional to disrupt the smelt with jet streams, e.g., steam jets, discharged from nozzles at low or medium pressure steam. These nozzles are referred to as shatter jet nozzles because they shatter the flow of the smelt.

The shatter jet nozzle discharges a jet stream at a specific volume and rate designed to break-up the smelt flow expected during normal operation of the recover boiler. The smelt flows at a relatively uniform rate and volumetric flow during normal recovery boiler operation. Conventional shatter jet nozzles direct a jet stream at a rate and volume designed to disrupt the normal uniform rate and flow of smelt. Conventional shatter jet nozzles are coupled to a single steam source that provides a constant flow rate of steam to the nozzles. The rate of steam flow to the nozzle typically cannot be adjusted remotely, and is adjusted at or near the nozzle.

Variations can occur in the rate and volume of smelt flowing from a recovery boiler. During normal operation of the recovery boiler, the normal steam jets from the shatter jet nozzles are capable of disrupting the smelt flow and sufficiently reducing explosions in the dissolving tank. However, the recovery boiler may be operated in an upset condition resulting in heavy smelt flows. These heavy smelt flows may not be adequately disrupted by the jets from the shatter jet nozzle and the smelt may cause explosions from which hot smelt droplets may splatter from the tank. These excessive explosions of smelt can result in equipment damage and danger to personnel safety.

BRIEF DESCRIPTION OF THE INVENTION

A shatter jet nozzle has been developed that discharges jets to breakup a smelt flow at two or more flow rates or pressures. The nozzle is coupled to two or more sources of steam (or other disrupting fluid) that provide the capacity for multiple rates or pressures of the jets. Further, the flow rate or pressure of the jets from the shatter jet nozzle may be manually or remotely controlled by controlling the flow of steam from one of the steam sources, such as by unblocking steam from a second steam source only during heavy smelt flows. By controlling the flow rate or pressure, the jet discharged from the shatter jet nozzle can be adjusted to breakup different rates of smelt flow. For example, the volume or pressure of the jets discharged from the shatter jet nozzle(s) may be increased during heavy smelt flows from the boiler and may be reduced during normal smelt flows.

An apparatus has been conceived and is disclosed herein to disrupt smelt flowing from a recovery boiler to a dissolving tank, the apparatus comprising: a shatter jet nozzle assembly arranged to direct a jet of disrupting fluid against the smelt flowing from the recovery boiler to the dissolving tank; a first source of disrupting fluid coupled to the shatter jet nozzle assembly; a second source of disrupting fluid coupled to the shatter jet nozzle assembly, and a valve arranged at or between the second source and the shatter jet nozzle assembly to regulate a flow of the disrupting fluid from the second source to a nozzle in the shatter jet nozzle assembly, wherein the apparatus has a first operating mode in which disrupting fluid from the first source flows through the shatter jet nozzle assembly and forms the jet of disrupting fluid discharged from the nozzle while the valve prevents disrupting fluid from the second source from being discharged from the jet, and a second operating mode in which disrupting fluid from the first and second sources flow through the shatter jet nozzle assembly to form the jet of disrupting fluid while the valve permits disrupting fluid to flow from the second source to the shatter jet nozzle assembly.

A method has been conceived and is disclosed herein to disrupt a smelt flow including: arranging a shatter jet nozzle assembly to direct a jet of disrupting fluid against the smelt flowing from a recovery boiler to a dissolving tank; supplying the disrupting fluid to the shatter jet nozzle assembly from a first source of disrupting fluid to form the jet directed against the smelt flow while a second source does not provide disrupting fluid to the shatter jet nozzle, and supplying the disrupting fluid from both the first source and the second source flow to the shatter jet nozzle assembly to form the jet of disrupting fluid directed against the smelt flow.

A shatter jet nozzle assembly has been conceived and is disclosed herein forming a jet applied to a smelt flowing from a recovery boiler and into a dissolving tank, the assembly comprising: a first nozzle conduit having a first discharge nozzle directed towards the smelt flow as the flow falls from the recovery boiler to a liquid surface in the dissolving tank, wherein the first nozzle conduit is connectable to a first source of disrupting fluid, wherein the disrupting fluid flows through the first nozzle conduit and from the first discharge nozzle to form a jet directed against the smelt flow, and a second nozzle conduit having a second discharge nozzle directed towards the smelt flow as the flow falls from the recovery boiler to a liquid surface in the dissolving tank, wherein the second nozzle conduit is connectable to a second source of disrupting fluid, wherein the disrupting fluid flows through the second nozzle conduit and from the second discharge nozzle to form a jet directed against the smelt flow, wherein the jet from the first discharge nozzle and the jet from the second discharge nozzle merge prior to the jets impacting the smelt flow.

BRIEF DESCRIPTION OF THE DRAWINGS

FIG. 2 is a schematic diagram showing a front view of the hood, smelt spout, shatter jet nozzle and dissolving tank, wherein FIG. 2 is a view along line 2-2 in FIG. 1.

DETAILED DESCRIPTION OF THE INVENTION

Figure 1:
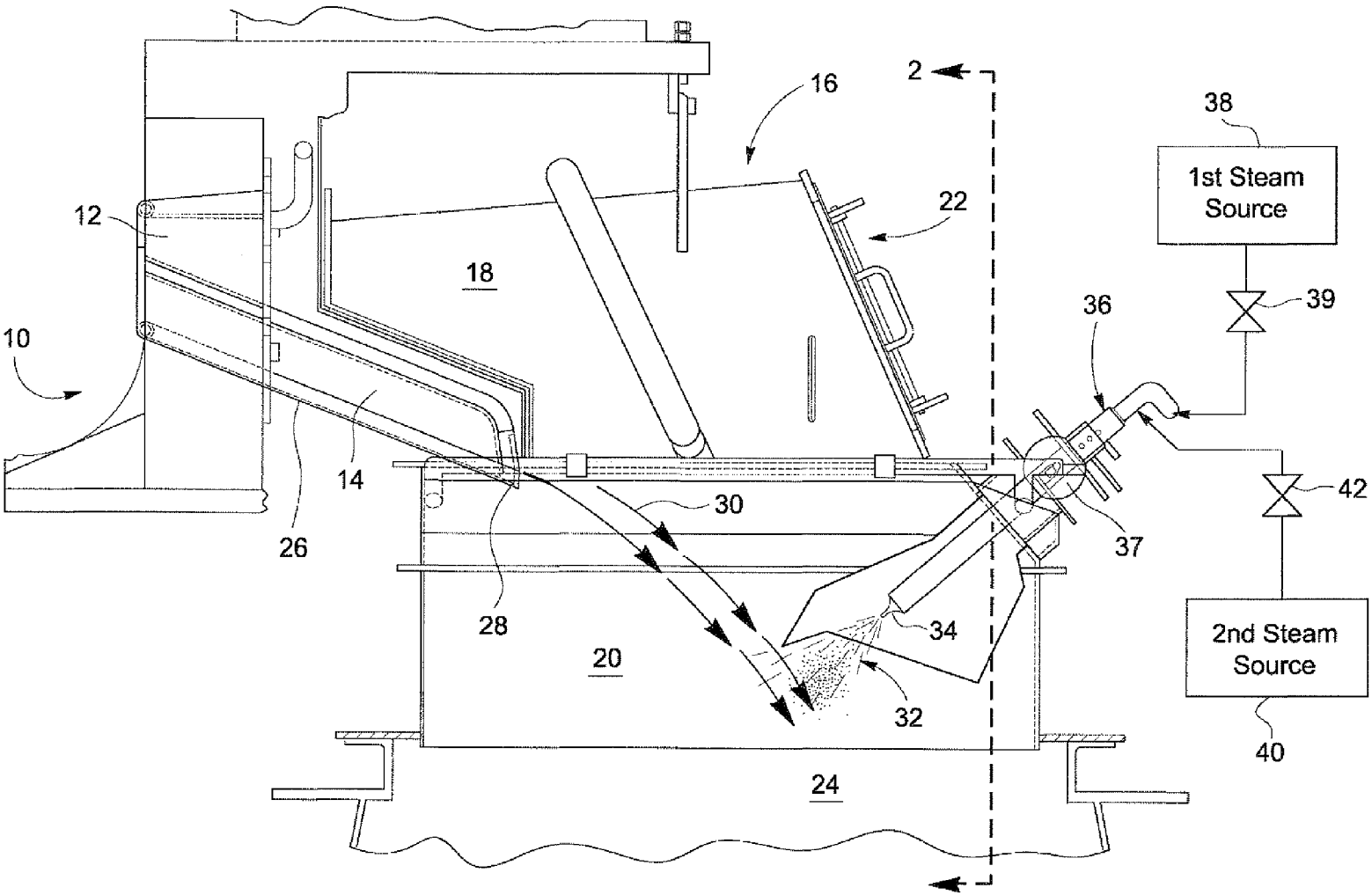
FIG. 1 is a is schematic diagram showing a side view, partially in cross-section, of a smelt hood, smelt spout, an upper portion of a dissolving tank and a shatter jet nozzle discharging a jet to break-up the smelt flow from the spout.
Figure 2:
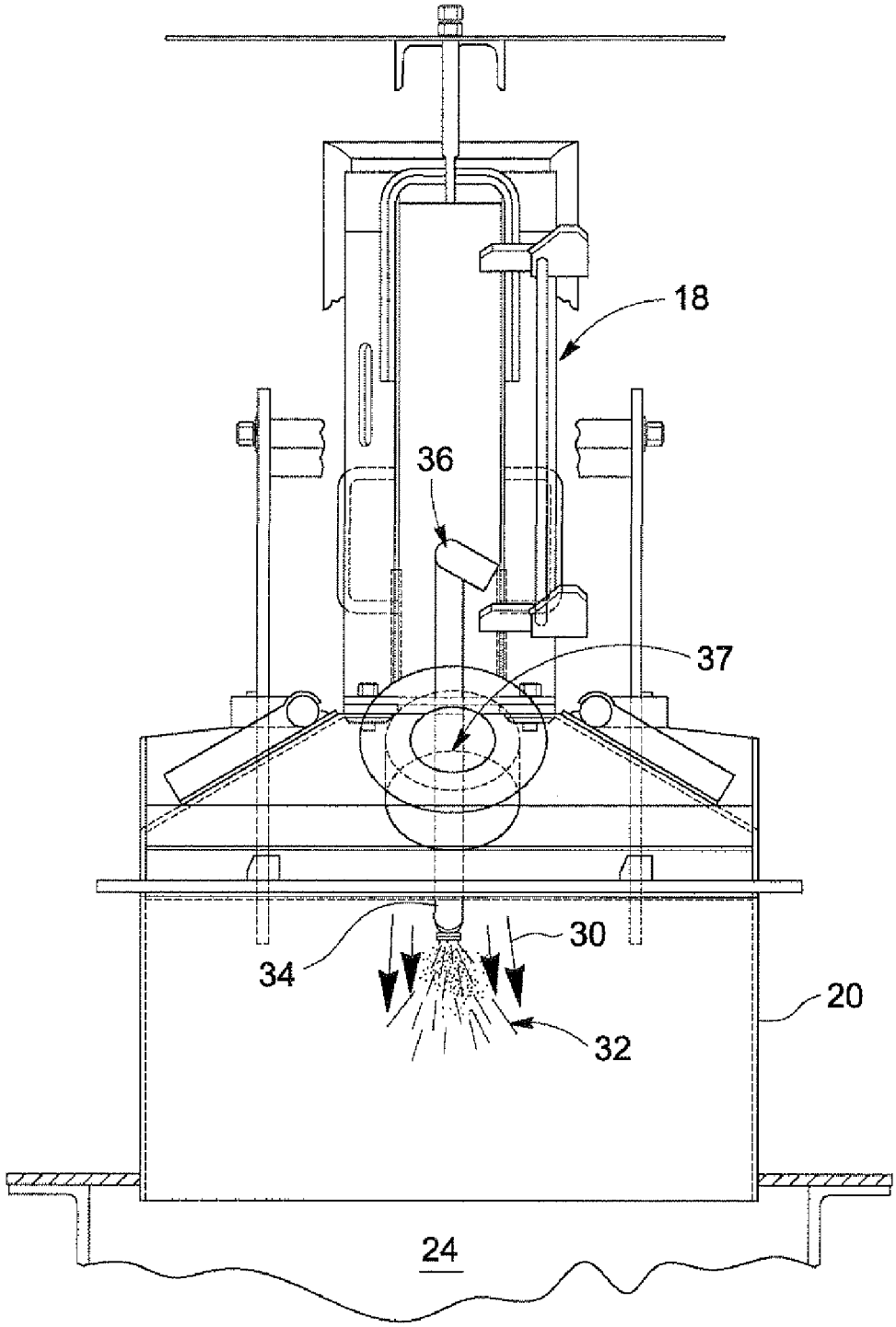

FIGS. 1 and 2 show a lower section of a recovery boiler 10 of a pulp mill. Smelt flows from the bottom of the boiler through an opening 12 and into a smelt spout 14. The portion of the smelt spout 14 extending outside the wall of the boiler is surrounded by a conventional closed protecting hood 16 comprising an upper hood portion 18 and a lower hood portion 20. The upper hood portion 18 includes a cover 22.

The hood 16 contains the splash of liquid and smelt as they flow through the spout 14 and contains exhaust gases so that the gases do not discharge directly to the environment. The lower hood portion 20 may be connected to a conventional dissolving tank 24 disposed under the protecting hood 16. The smelt dissolves into liquid in the tank 24 to produce green liquor.

Hot, liquid smelt flows from a boiler opening 12 near the bottom of the recovery boiler to the smelt spout 14. The smelt flows along a downwardly sloped bottom 26 of the spout 14, over a free end 28 of the spout, and into the dissolving tank 24. The smelt flow path as the smelt falls from the free end 28 to the spout to the liquid surface in the tank is indicated by arrows 30.

A jet 32 of steam or other disrupting fluid is directed against the smelt as the smelt flows from the free end 28 of the spout to the tank. The jet 32 disrupts the flow of smelt into droplets, segments the flow or otherwise breaks up the flow such that there is not a uniform stream of smelt entering the tank. The jet 32 is discharged from nozzle 34 of a shatter jet nozzle assembly 36.

The shatter jet nozzle assembly 36 may be attached to an adjustable mounting bracket 37 fixed to the lower portion 20 of the hood 16. The adjustable mounting bracket allows the shatter jet nozzle assembly to be moveably positioned to direct the jet 32 against the flow of smelt 30. Optionally, opposite shatter jet nozzle assemblies may be mounted to the lower portion 20 of the hood to project disrupting fluid jets from opposite sides of the smelt flow to enhance the breakup of the smelt flow before the smelt reaches the liquid level in the dissolving tank.

During normal operation of the recovery boiler 10, steam or other disrupting fluid is supplied to the shatter jet nozzle assembly by a first pressurized fluid source 38, such as a source of low pressure or medium pressure steam. The first pressurized fluid source 38 may a pressurized header of steam or other disrupting fluid. Alternatively, the fluid source 38 may be a conduit with a pump coupled to a tank, such as the dissolving tank 24 of the weak white liquor or green liquor.

The first pressurized fluid source 38 may provide fluid, e.g., steam or other gas, to the shatter jet nozzle assembly 36 at a first pressure level. The pressure of the first pressurized fluid source may be selected to be adequate to produce a jet 32 from the shatter jet nozzle 34 sufficient to breakup the smelt flow during normal operation of the recovery boiler. The volume or flow rate of disrupting fluid from the first pressurized fluid source to the nozzle assembly 36 is sufficient to fully supply the shatter jet nozzle assembly with a jet 32 adequate to breakup the flow of smelt during normal boiler operation.

A first valve 39 connected to a conduit extending from the first pressurized fluid source 38 to the shatter jet nozzle assembly 36 regulates the flow of disrupting fluid, which may be a low-pressure flow, to the nozzle assembly. The first valve 39 may be remote, e.g., twenty feet distant, from the protective hood 16 or the valve may be proximate to the hood. The first valve 39 may be manually operated or remotely controlled by a solenoid affixed to the valve. The first valve is typically open to a fixed position during operation of the recovery boiler to provide a continuous flow of disrupting fluid to the shatter jet nozzle assembly 36.

A second source 40 of disrupting fluid may also be connected to the shatter jet nozzle assembly 36. The second source 40 provides disrupting fluid that may be at the same or a higher pressure than the first fluid source. The second source 40 may be disrupting fluid in a pressurized header containing steam or other disrupting fluid. Alternatively, the second source 40 may be provided by a pump which pressurizes disrupting fluid, such as liquor from the dissolving tank or water.

The second source 40 provides supplemental disrupting fluid that increases the volume or pressure of the jet 32, over and above the volume or pressure of the jet 32 when supplied solely from the first pressure source. The high velocity and pressure jet 32 formed by the combine flow of disrupting fluid from the first and second sources 38, 40 may be applied to breakup heavy smelt flows that occur during an upset condition in the recovery boiler.

A second valve 42 is connected to a conduit extending from the second pressurized fluid source 40 to the shatter jet nozzle assembly 36. The second valve 42 regulates the flow of disrupting fluid, which may be a high pressure flow, to the nozzle assembly. The second valve 42 may be remote, e.g., twenty feet distant, from the protective hood 16 or the valve may be proximate to the hood. The second valve 42 may be manually operated or remotely controlled by a solenoid affixed to the second valve. The second valve 42 may be opened to allow flow from the second pressurized fluid source 40 only during extraordinary conditions, such as during heavy smelt flows. Because the second valve is remote to the hood or is remotely operable, the second valve may be safely opened after heavy smelt flow begins and explosions are occurring as the smelt flow hits the cool liquor in the dissolving tank 24.

Figure 3:
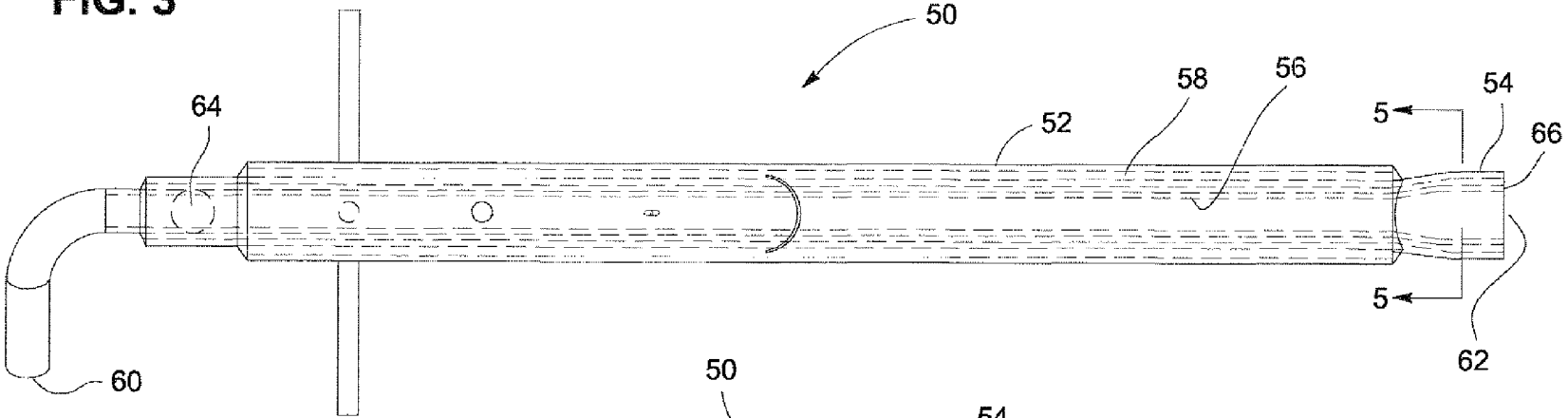
FIG. 3 is a side view of an exemplary shatter jet nozzle having concentric passages for multiple flows of disrupting fluid.
Figure 5:
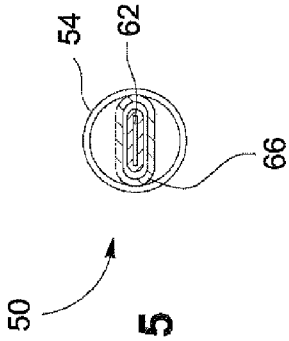
FIG. 5 is a cross-sectional view of the distal end of the nozzle taken along line 5-5 in FIG. 3.
Figure 4:
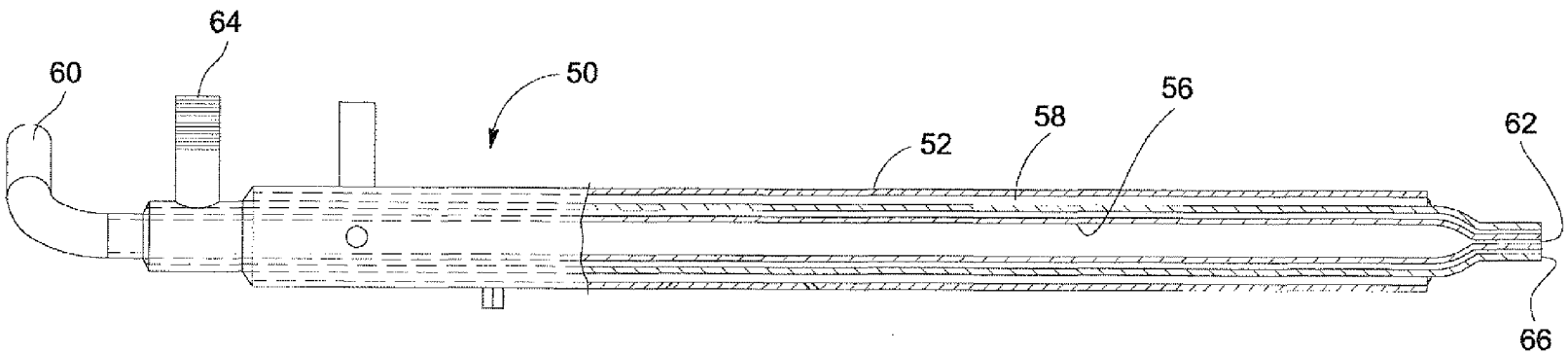
FIG. 4 is another side view, shown in partial cross section, of the shatter jet nozzle, wherein the view is taken from a ninety degree angle from the view shown in FIG. 3.

FIGS. 3 to 5 show an exemplary shatter jet nozzle assembly 50 which has a generally cylindrical metallic housing 52 which extends substantially the length of the assembly and provides shielding to protect the assembly from smelt. A distal end of the assembly includes a bell housing 54 (not shown in FIG. 4) that provides a shield to the nozzle end of the assembly. Housed within the housings 52 and 54 are coaxial tubes 56 and 58 that define conduits for the two flows of pressurized disrupting fluid, e.g., steam.

A center inlet 60 to a center coaxial tube 56 is coupled to one of the sources of disrupting fluid, such as the first steam source 38. The center inlet 60 directs disrupting fluid from the first source into the center coaxial tube 56 such that the fluid flows to a center nozzle 62, which may have an oval shape in cross-section as is shown in FIG. 5.

A side inlet 64 to the outer coaxial tube 58 is coupled to another source of disrupting fluid, such as the second steam source 40. The side inlet directs disrupting from the second source through an annular passage between the outer and inner coaxial tubes to an outer nozzle 66 that surrounds the center nozzle 62. The outer nozzle 66 may have a racetrack shape such as shown in FIG. 5. The center nozzle 62 and outer nozzle 66 may be coaxial and have adjacent openings at a common outlet for the nozzle assembly.

The length of the nozzle assembly 50 is sufficient to position the nozzles 66, 62 adjacent to the flow of smelt from the spout. The nozzle assembly is preferably mounted to the protecting hood 16, so that the nozzles 66, 62 may be turned and positioned properly with respect to the smelt flow.

With the nozzle assembly 50 disclosed herein, the breakup of the smelt is more efficient and safer, especially during heavy smelt flows from a recovery boiler. The ability to discharge jets from two nozzles 62, 66 in the nozzle assembly 50 reduces the risk of extensive explosions in the dissolving tank and the noise level is reduced in the vicinity of the dissolving tank even during heavy smelt flows.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. An apparatus to disrupt smelt flowing from a recovery boiler to a dissolving tank, the apparatus comprising:

a shatter jet nozzle assembly arranged to direct a stream of disrupting fluid against the smelt flowing from the recovery boiler to the dissolving tank;

a first source of disrupting fluid coupled to the shatter jet nozzle assembly;

a second source of disrupting fluid coupled to the shatter jet nozzle assembly, and a valve arranged at or between the second source and the shatter jet nozzle assembly and configured to control a flow of the disrupting fluid from the second source to a nozzle in the shatter jet nozzle assembly, wherein the apparatus has a first operating mode in which disrupting fluid from the first source flows through the shatter jet nozzle assembly and forms the stream of disrupting fluid discharged from the nozzle and the valve is closed disrupting fluid from the second source is prevented by the closed valve from being discharged from the jet nozzle assembly during the first operating mode, and a second operating mode in which disrupting fluid from the first and second sources flow through the shatter jet nozzle assembly to form at least one stream of disrupting fluid and the valve is opened such that disrupting fluid flows from the second source to the shatter jet nozzle assembly during the second operating mode.

2. The apparatus of claim 1 wherein the first and second sources supply the disrupting fluid at substantially the same pressure.

3. The apparatus of claim 1 wherein the first source supplies the disrupting fluid at a pressure lower than a pressure at which the disrupting fluid is supplied from the second source.

4. The apparatus as in claim 1 wherein shatter jet nozzle assembly includes a first conduit for disrupting fluid flowing from the first source and a second conduit for disrupting fluid flowing from the second source.

5. The apparatus of claim 4 wherein the second conduit and the first conduit are coaxial.

6. The apparatus as in claim 1 wherein the valve is remotely operable to switch the apparatus between the first mode and the second mode.

7. The apparatus as in claim 1 wherein the apparatus is operated in the second mode while the smelt flows at a greater rate than the smelt flow for which the apparatus is operated in the first mode.

8. A shatter jet nozzle assembly configured to be aligned with smelt flowing from a recovery boiler and into a dissolving tank, the assembly comprising:

a first nozzle conduit having a first discharge nozzle directed towards the smelt flow as the flow falls from the recovery boiler to a liquid surface in the dissolving tank, wherein the first nozzle conduit is connectable to a first source of disrupting fluid, wherein the disrupting fluid flows through the first nozzle conduit and from the first discharge nozzle to form a first stream directed against the smelt flow;

a second nozzle conduit having a second discharge nozzle directed towards the smelt flow as the smelt flow falls from the recovery boiler to a liquid surface in the dissolving tank, wherein the second nozzle conduit is connectable to a second source of disrupting fluid, wherein the disrupting fluid flows through the second nozzle conduit and from the second discharge nozzle to form a second stream directed against the smelt flow, wherein the first stream from the first discharge nozzle and the second stream from the second discharge nozzle merge prior to the streams impacting the smelt flow, and a valve connected to the second nozzle conduit, wherein the valve is closed during the first mode of operation of the shatter jet nozzle assembly, and during the first mode the smelt flow is at a first flow rate, the closed valve prevents the disrupting fluid from the second source from flowing to the second nozzle conduit, and during a second mode of operation of the shatter jet nozzle assembly selected in response to the smelt flow being at a second flow rate greater than the first flow rate, the valve is opened and the disrupting fluid from the second source flows through the open valve to the second nozzle conduit to form the second stream.

9. The shatter jet nozzle assembly of claim 8 wherein the second nozzle conduit is coaxial with the first nozzle conduit.

10. The shatter jet nozzle assembly of claim 8 wherein the second discharge nozzle is adjacent the first discharge nozzle.

11. A method to disrupt a smelt flow comprising:

arranging a shatter jet nozzle assembly to direct a stream of disrupting fluid against the smelt flowing from a recovery boiler to a dissolving tank;

while the smelt flows at a first rate, supplying the disrupting fluid to the shatter jet nozzle assembly from a first source of disrupting fluid to form the stream directed against the smelt flow while a second source does not provide disrupting fluid to the shatter jet nozzle, and while the smelt flows at a second rate greater than the first rate, supplying the disrupting fluid from both the first source and the second source to the shatter stream nozzle assembly to form at least one stream of disrupting fluid directed against the smelt flow.

12. The method as in claim 11 wherein supplying the disrupting fluid from both the first source and the second source is performed in response to an increase in the smelt flow.

13. The method as in claim 11 wherein the first and second sources supply the disrupting fluid at substantially the same pressure.

14. The method as in claim 11 wherein the first source supplies the disrupting fluid at a pressure lower than the pressure the disrupting fluid is supplied from the second source.

15. The method as in claim 11 wherein the disrupting fluid flowing from the first source and the disrupting fluid flowing from the second source merge after being discharged from the shatter jet nozzle assembly.

16. The method as in claim 11 wherein the shatter jet nozzle assembly has a first nozzle conduit coupled to the first source and a second nozzle conduit, concentric to the first nozzle conduit, coupled to the second source, wherein the disrupting fluid flows from a nozzle at a discharge end of the first nozzle conduit or from nozzles at the discharge end of both the first and second nozzle conduits.

17. The method as in claim 16 wherein the nozzle for the second nozzle conduit is adjacent the first discharge nozzle.

* * * * *